United States Patent [19]

Jaconette, Jr.

[11] 4,138,185

[45] Feb. 6, 1979

[54] ELECTRIC CORD CLAMP DEVICE

[75] Inventor: Frank C. Jaconette, Jr., Trumbull, Conn.

[73] Assignee: Harvey Hubbell, Incorporated, Orange, Conn.

[21] Appl. No.: 839,205

[22] Filed: Oct. 4, 1977

[51] Int. Cl.[2] ..... H01R 13/58

[52] U.S. Cl. ..... 339/107; 174/156; 339/196 M

[58] Field of Search ..... 339/107, 110 P, 196 M, 339/196 A; 174/156

[56] References Cited

U.S. PATENT DOCUMENTS

| | | | |
|---|---|---|---|
| 3,784,961 | 1/1974 | Gartland, Jr. | 339/107 |
| 3,787,798 | 1/1974 | Carissimi et al. | 339/107 |
| 4,006,958 | 2/1977 | Kramer et al. | 339/110 P |
| 4,010,999 | 3/1977 | Hoffman | 339/107 |

*Primary Examiner*—Roy Lake

*Assistant Examiner*—DeWalden W. Jones

*Attorney, Agent, or Firm*—Jerry M. Presson

[57] ABSTRACT

Two separate but identically shaped sections cooperate to form an electrical cord gripping device when they are brought together. The sections are insertable into recesses in cooperating halves of an electrical housing, by wedging or snapping them into place, and, when the housing is closed, the sections form a restricted opening and provide a clamp around an electrical cord passing through the opening and into the housing. The sections are readily removable from the housing, so that a single housing can be used with electrical cords of different sizes. Further, each section contains a diagonal rib, and, when the sections are brought together, their ribs criss-cross one another to grip the cord from opposite sides. The sections are also shaped to provide abutting surfaces which overlap each other to cam the sheathing of the electrical cord into the opening provided by the sections, and prevent crimping of the sheathing.

16 Claims, 5 Drawing Figures

Fig. 1.
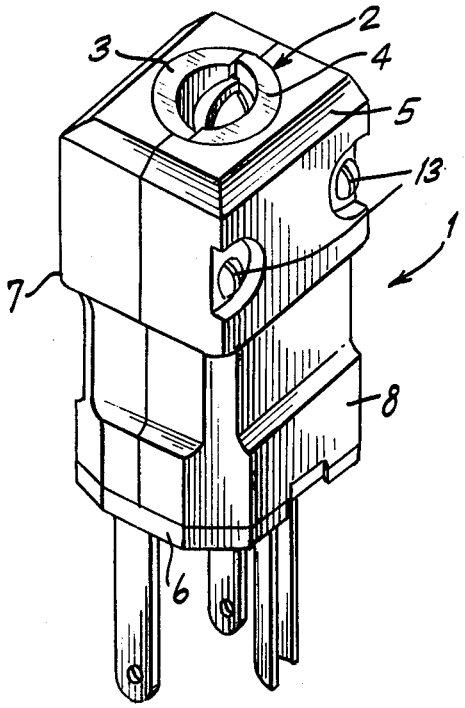
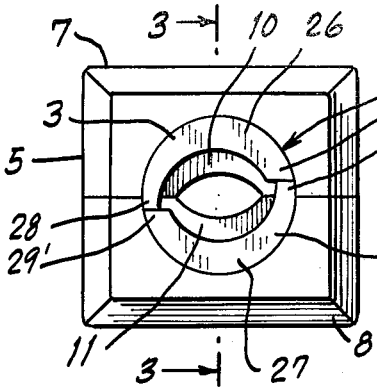
Fig. 2.
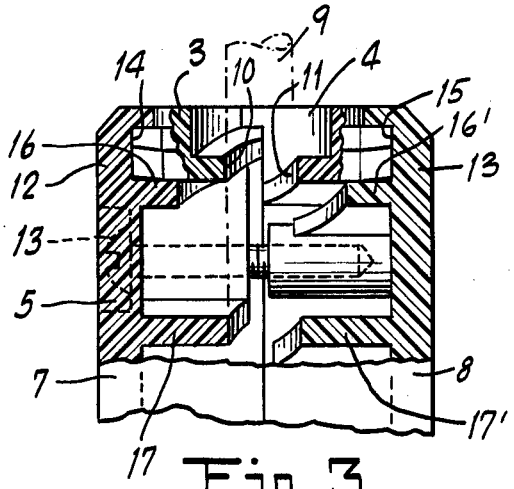
Fig. 3.
Fig. 4.
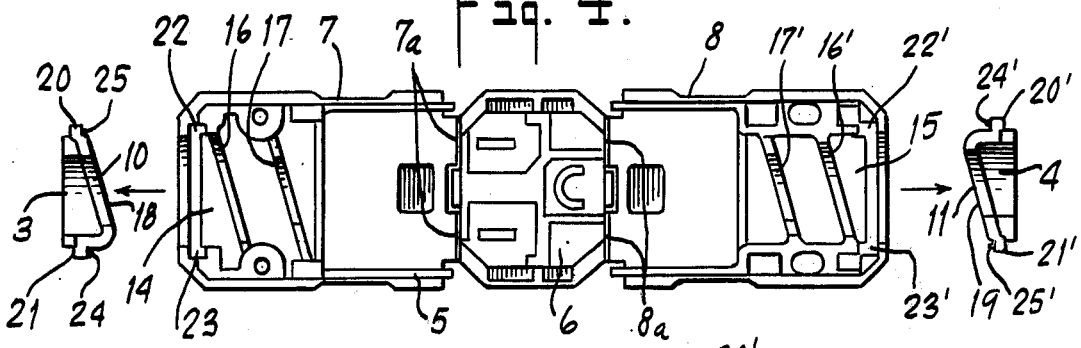
Fig. 5.
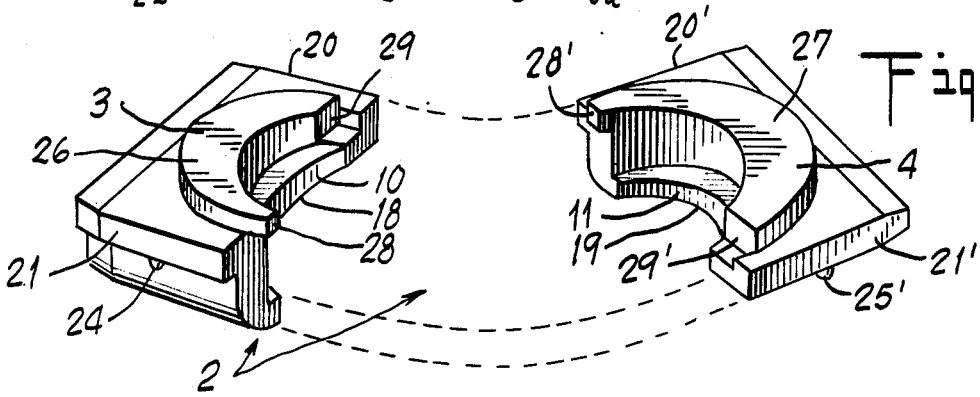

ELECTRIC CORD CLAMP DEVICE

BACKGROUND OF THE INVENTION

Clamping devices for electrical cords have been in use for many years. They generally take the form of integral cooperating portions of an electrical housing, such as a housing for a plug or receptacle, but some insert types have been proposed.

This invention relates to a clamping device of the insert type made of two separate but identically shaped sections which are slideably inserted into recesses in cooperating halves of a suitable electrical housing, and which result in a complete clamping device when the cooperating halves of the housing are brought together.

SUMMARY OF THE INVENTION

The invention concerns a clamping device for an electrical cord which is economical to manufacture and simple to handle and use, and which has immediate application in existing electrical plug and receptacle housings.

More specifically, the invention concerns a cord clamping device formed by two separate but identically shaped sections which are insertable into recesses in cooperating halves of an electrical plug or receptacle housing, such as disclosed in U.S. Pat. No. 4,010,999, which sections clamp an electrical cord passing into the housing when the cooperating halves of the housing are brought together. Once inserted, the sections are maintained in place by friction or restraining protuberances, so that they will not be dislodged when conductors of the cord are being inspected or connected to terminals in the housing. However, the sections are readily removable and replaceable so that the housing can accommodate electrical cords of different sizes.

As already noted, each section contains a diagonal rib, so that the ribs of two sections will criss-cross one another, to provide a gripping hold on the cord, when the two sections are brought together. The identical construction of the sections provides ease in handling, inventory and distribution.

The use of two identical inserts also ensures that the restricted opening they provide will always be centered in the entry passage of the supporting housing. This is important since electrical housings of the type relevant here are conventionally constructed to provide uniform path lengths from the axis of the cord entry passage to the terminals within the housing. Thus, when the cord is centered in the entry passage of the housing, its wires can all be cut to have the same length, and the wiring connections readily made, without the distortions and stresses which would be produced by an off-center cord.

Other features of the invention will become apparent from the following description of the preferred embodiment of the invention.

DRAWINGS

FIG. 1 is a perspective view of an electrical plug of the dead-front type, the top of the housing containing a cord clamp formed by two sections in accordance with the present invention.

FIG. 2 is a top view of the housing of FIG. 1, showing the cord clamp sections.

FIG. 3 is a side view of the housing of FIG. 1, partly broken away to show the interior of the housing along lines 3—3 of FIG. 2.

FIG. 4 is a plan view of the interior of the electrical plug of FIGS. 1 to 3, with the sides of the housing in an open condition, and with the cord clamp sections shown alongside the opposite ends of the housing.

FIG. 5 is a perspective view of the cord clamp sections.

DESCRIPTION OF PREFERRED EMBODIMENT

Considering the drawings in more detail, FIGS. 1 to 4 show the sections 3 and 4 of a cord clamp 2 associated with a housing 5 of an electrical plug 1, while FIG. 5 shows the cord clamp sections 3 and 4 apart from the supporting housing 5.

The sections 3 and 4 contain raised arcuate portions 26 and 27 and arcuate gripping ribs 10 and 11, which can be seen in FIGS. 1 and 2. The ribs 10 and 11 are diagonally disposed, as best shown in FIGS. 4 and 5, and they form a restricted opening when the sections are brought together. These ribs serve to grip the electrical cord 9 on its opposite sides.

As evident from FIGS. 4 and 5, when the sections 3 and 4 are brought together, even though these sections are identical, their diagonal ribs 10 and 11 slope in the opposite directions, so as to criss-cross one another on opposite sides of the cord 9.

The sections 3 and 4 also include lateral flanges 20 and 21 on their opposite sides for mounting purposes, as will be discussed. Each such flange preferably includes one or more protuberances 24 and 25 to ensure a tight fit between the flange and its receiving guideway and yet permit easy removal.

As shown in FIG. 5, one edge 28 of each raised arcuate portion 26 and 27 projects beyond the underlying material, while the opposite edge 29 is cut back or recessed in relation to the underlying material. As a consequence, when the sections are brought together the projections 28 are matingly received by the recesses 29, so that the edges of the sections overlap. Such overlapping serves to prevent an electrical cord from being crimped between the abutting edges of the sections, since the projections 28 tend to cam the cord into the central opening provided between the sections. This camming action occurs as soon as each projection 28 reaches the ledge or shoulder of the receiving recess 29, even before the sections 3 and 4 fully engage one another. Also, it continues even if for some reason a slight separation develops between the sections 3 and 4.

The cord clamping sections 3 and 4 of the present invention can be used in any electrical housing which has complementary halves that close upon each other, and provide a passageway for an electrical cord, one section of the clamping unit being inserted in each of the complementary halves. The sections are, however, advantageously employed in an electrical plug or receptacle of the configuration illustrated in FIGS. 1 to 4.

The plug 1 is a one-piece unit, preferably made of plastic, having a dead-front or face 6, and sides 7 and 8. The plastic material is thinned in the areas **7*a* and 8*a*, which connect the front with the sides, to provide a hinge-like connection. Thus, the sides 7 and 8 may be opened as shown in FIG. 4, to make wiring connections between the electrical cord 9 and terminals (not shown) within the housing, or for subsequent inspection or repair. Also, once wired, or inspected or repaired, the sides can be closed, as shown in FIGS. 1 to 3, and holding screws 13 tightened to maintain the unit closed and the sections 3 and 4 clamped against the electrical cord 9**.

As shown in FIGS. 3 and 4, the sides 7 and 8 of the plug each contain diagonal gripping ribs 16 and 17, similar to ribs 10 and 11 in the sections 3 and 4. Also, there may be diagonal reinforcing ribs located between ribs 16 and 17, for added strength, but for convenience of illustration such reinforcing ribs have not been shown. When the sides 7 and 8 are closed, the ribs 16 cross one another in a criss-cross fashion, as discussed in connection with ribs 10 and 11 of the insert sections 3 and 4, and the same is true of the ribs 17. In this manner, as discussed, a greater gripping action is obtained without placing undue stress on the cord.

As shown in FIG. 3, and indicated by the shading in FIG. 4, the diagonal ribs 16 and 17 have curved inner surfaces which provide an opening for the electrical cord 9. The ribs 17 extend further inwardly, toward the central axis of the cord 9, than do the ribs 16.

As shown in FIGS. 3 and 4, the sides 7 and 8 of the housing 1 include recesses or cavities 14 and 15, adjacent ribs 16, for receiving the sections 3 and 4. Since the cavities 14 and 15 are contiguous the diagonal ribs 16, one boundary of these cavities is diagonal, and, as a consequence, the same is true of the lower edges of the sections 3 and 4. When the inserts 3 and 4 are in place in these cavities, their ribs 10 and 11 extend inwardly toward cord 9 the same distance as ribs 17, as shown in FIG. 3.

The cavities 14 and 15 in sides 7 and 8 include guideways 22 and 23 on their opposite sides, to receive the flanges 20 and 21 of the sections 3 and 4. When a section 3 or 4 is inserted, its flanges 20 and 21 slide into the guideways 22 and 23, and these guideways snugly engage the flanges, so that the section will remain in place while connections are being made between the conductors of the cord 9 and terminals within the housing, or such connections are subsequently being inspected or repaired.

As already noted, the flanges 20 and 21 preferably include one or more protuberances 24 and 25, or such protuberances may project from the surfaces of the guideways 22 and 23, so that the snug fit between the flanges and the guideways is concentrated at these protuberances, for easy removal of the sections. In this manner a snug fit may be achieved and yet a cord clamp section may readily be removed by grasping it and pulling it away from its supporting cavity. The housing can then be used without the sections or the sections can be replaced by ones of a different size.

Thus, the cord clamp sections can be inserted in place in the cavities of the housing without fear that they will be dislodged during wiring or assembly, but if desired, such as when the housing is to be used with an electric cord of a different size, the sections can readily be removed.

Removal of a section can be accomplished simply by grasping it between a thumb and forefinger and pulling it away from its cavity, or by inserting a fingernail behind the curved outer edge of the raised arcuate portion 26 or 27 of the section, and grasping and pulling it away from its cavity. To facilitate removal a slight recess may be provided between the curved edges of portions 26 and 27 and the adjoining upper surface 5 of the housing, when the flanges 20 and 21 of the section have been fully inserted into the guideways 22 and 23. This recess, however, is not essential. While the outer edges of the arcuate portions 26 and 27 have been shown curved, they can be squared off or have any other shape desired, consistent with a corresponding change in the upper surface 5 of the housing. Further, while the upper surfaces of sections 3 or 4 are shown coplanar with the upper surface 5 of the housing, as shown in FIG. 3, for ease in grasping the sections they can extend or project upwardly beyond the housing.

In the use of the plug 1 with the cord clamp sections 3 and 4 present in the cavities 14 and 15, since the diagonal ribs 10 and 11 of these sections are aligned with the lower diagonal ribs 17 of the housing, the housing can receive and effectively clamp a relatively small diameter electrical cord, such as the electrical cord for a 15-amp service.

When the inserts 3 and 4 are removed, however, the housing 1 is adapted to receive, and effectively clamp, a larger diameter cord, such as the cord for a 20-amp service. This is true even though the ribs 17 of the housing 1 extend inwardly toward the axis of the electrical cord 9 further than ribs 16. Since the holding screws 13 lie between the ribs 16 and 17, and the pivot axes for the sides 7 and 8 of the housing lie adjacent the face 6, when the screws are tightened, they will cause ribs 17 to clamp tightly on the cord 9, even when the cord is relatively large. However, they have less control over the tightness of the clamping of the ribs 16, which are further from the axes of the sides 7 and 8, so that a larger opening is required through ribs 16 for larger-sized cords.

Thus, the housing 1, with its integral ribs 16 and 17, services 20-amp electrical cords when the insert sections 3 and 4 are removed, and 15-amp electrical cords when they are in place. In addition, different sized sections 3 and 4 can be employed for other variations in cord size. And, as already noted, sections 3 and 4 can be employed in other housings, where they can be removed and replaced by different sized sections to accommodate different cord sizes.

The housing 1 corresponds to the housing disclosed in applicant's U.S. Pat. No. 4,010,999, which is incorporated herein by reference, except that the housing in that patent has gripping ribs, such as ribs 16 and 17, of equal dimensions.

As explained in U.S. Pat. No. 4,010,999, the housing 1 is formed integrally of a high strength insulating material, such as nylon. The same is true of the insert sections 3 and 4. Both the housing and the individual sections are preferably injection molded as one-piece structures, as will be apparent to one skilled in the art.

It should be understood that changes in details of the construction may be made without departing from the spirit and scope of the invention, which is defined by the following claims.

I claim:

1. An electrical terminal unit comprising:

a front member containing apertures for the passage of conductive members, two side members hingedly attached to said front member, each of said side members being pivotally movable about its hinged attachment to a closed position abutting the other side member and enclosing the back of the front member, and to an open position giving access to the back of the front member, each of said side members including a cavity in its interior surface which faces the other side member, at a location spaced from its hinged attachment to the front member, said cavities being substantially aligned with one another when said side members are in a closed position, and a cord clamp formed of two sections which are separable from one another and which form a passage for an electrical cord when brought together, each of said sections being snugly, but removably, engaged in one of said cavities to remain in said cavity when said side members are in an open position and to be brought together in facing relationship with the other section, to provide a clamping engagement about an electrical cord, when said side members are in a closed position, each of the cavities including one or more guideways extending in a direction away from the interior face of the side member, each of said cord clamp sections including one or more flanges each dimensioned to fit into one of said guideways, whereby said sections may be removably inserted into said cavities, and at least one surface irregularity between the adjoining surfaces of each guideway and the associated flange for providing a snug fit between said adjoining surfaces.

2. An electrical terminal unit as in claim 1 wherein said surface irregularity constitutes a protuberance projecting from one of said adjoining surfaces toward the other.

3. An electrical terminal unit comprising:

a front member containing apertures for the passage of conductive members, two side members hingedly attached to said front member, each of said side members being pivotally movable about its hinged attachment to a closed position abutting the other side member and enclosing the back of the front member, and to an open position giving access to the back of the front member, each of said side members including a cavity in its interior surface which faces the other side member, at a location spaced from its hinged attachment to the front member, said cavities being substantially aligned with one another when said side members are in a closed position, and a cord clamp formed of two sections which are separable from one another and which form a passage for an electrical cord when brought together, each of said sections being snugly, but removably, engaged in one of said cavities to remain in said cavity when said side members are in an open position and to be brought together in facing relationship with the other section, to provide a clamping engagement about an electrical cord, when said side members are in a closed position, each of said cavities including a pair of channels disposed at opposite sides of the cavity and serving as guideways for receipt of a section, each said section including portions dimensioned to fit snugly into said channels to be slidingly inserted therealong.

4. An electrical terminal unit as in claim 3 further including one or more protuberances along the adjoining surfaces between each channel and the corresponding portion of the cord clamp section, to maintain a snug but removable hold on the section.

5. An electrical terminal unit comprising:

a front member containing apertures for the passage of conductive members, two side members hingedly attached to said front member, each of said side members being pivotally movable about its hinged attachment to a closed position abutting the other side member and enclosing the back of the front member, and to an open position giving access to the back of the front member, each of said side members including a cavity in its interior surface which faces the other side member, at a location spaced from its hinged attachment to the front member, said cavities being substantially aligned with one another when said side members are in a closed position, and a cord clamp formed of two sections which are separable from one another and which form a passage for an electrical cord when brought together, each of said sections being snugly, but removably, engaged in one of said cavities to remain in said cavity when said side members are in an open position and to be brought together in facing relationship with the other section, to provide a clamping engagement about an electrical cord, when said side members are in a closed position, said sections abutting one another on opposite sides of the passage they provide, each of said sections including a projection at one of its abutting surfaces and a recess at the other, and the projections and recesses of said sections meeting one another in mating and overlapping engagement.

6. An electrical terminal unit as in claim 5 wherein the surfaces of the cord clamp sections overlap, to form a continuous surface surrounding the passage, before the sections are fully engaged with one another.

7. An electrical terminal unit as in claim 6 wherein the two cord clamp sections are substantially identically shaped.

8. An electrical terminal unit comprising:

a front member containing apertures for the passage of conductive members, two side members hingedly attached to said front member, each of said side members being pivotally movable about its hinged attachment to a closed position abutting the other side member and enclosing the back of the front member, and to an open position giving access to the back of the front member, each of said side members including a cavity in its interior surface which faces the other side member, at a location spaced from its hinged attachment to the front member, said cavities being substantially aligned with one another when said side members are in a closed position, and a cord clamp formed of two sections which are separable from one another and which form a passage for an electrical cord when brought together, each of said sections being snugly, but removably, engaged in one of said cavities to remain in said cavity when said side members are in an open position and to be brought together in facing relationship with the other section, to provide a clamping engagement about an electrical cord, when said side members are in a closed position, each of said sections including a diagonal gripping rib, the ribs on the two sections sloping diagonally in opposite directions on the opposite sides of said passage.

9. An electrical terminal unit comprising:

a front member containing apertures for the passage of conductive members, two side members hingedly attached to said front member, each of said side members being pivotally movable about its hinged attachment to a closed position abutting the other side member and enclosing the area in back of the front member, and to an open position giving access to the area in back of the front member, each of said side members having a pair of diagonal gripping ribs extending inwardly from its interior surface which faces the other member, at a location spaced from its hinged attachment to the front member, the diagonal ribs on one of said side members sloping in the opposite direction from those on the other side member, when the side members are in a closed position, each of said side members also including a cavity in its interior surface, said cavities being substantially aligned with one another when said side members are in a closed position, and a cord clamp formed of two sections which are separable from one another and which form a complete electrical cord clamp when brought together, each of said sections being snugly, but removably, engaged in one of said cavities to remain in said cavity when said side members are in an open position and to be brought together in facing relationship with the other section, and in clamping engagement about an electrical cord, when said side members are in a closed position, each of said sections also including a diagonal gripping rib.

10. An electrical terminal unit as in claim 9, wherein the cord clamp sections provide an opening for the passage of the electrical cord when they are in abutting engagement, wherein one of the ribs on each side member extends closer to the axis of said opening than does the other rib on the same side member, and wherein, when the cord clamp sections are in place in the cavities, the gripping rib of each section extends toward the axis of said opening substantially the same distance as one of the ribs on the associated side member.

11. An electrical cord clamp comprising two separate complementary cord clamp sections which, when brought together, form a complete cord clamp containing an aperture for passage of an electrical cord therethrough, each of said sections having a diagonal gripping rib for gripping the electrical cord passing through said aperture, each of said sections being substantially identical to one another, and each being insertable into a supporting cavity in an electrical housing member and removable therefrom, to be removably retained therein, and the gripping ribs on the two sections sloping in opposite directions when the two sections are brought together, to provide a criss-cross grip on the opposite surfaces of the electrical cord.

12. An electrical cord clamp as in claim 11 wherein each of said sections has flanges extending laterally from its opposite sides for passage along guideways of a supporting cavity.

13. An electrical cord clamp as in claim 12 further including at least one protuberance projecting outwardly from the surface of each of said flanges to provide a tight releasable fit in said supporting cavities.

14. An electrical cord clamp as in claim 11 wherein said sections abut one another along surfaces outside of said aperture, each of said sections including a projection at one of its abutting surfaces and a recess at the other, and the projections and recesses of said sections meeting one another in mating engagement, so that the sections fit together in overlapping engagement when they are brought together.

15. An electrical cord clamp comprising at least two sections each having mounting surfaces to fit snugly and removably within a cavity of a housing unit, each of said sections having an arcuate region along its surface and bearing surfaces at the opposite ends of the arcuate region, said arcuate regions defining a passageway for an electrical cord when said sections are brought together at their bearing surfaces, each said section having a diagonal gripping rib extending inwardly into said passageway from the arcuate region of the section, said diagonal gripping ribs providing a grip against the electrical cord which passes through said passageway.

16. An electrical cord clamp as in claim 15 wherein the gripping inner edges of said diagonal ribs are arcuate, and the diagonal ribs of the sections criss-cross one another on opposite sides of the electrical cord, when the sections are brought together.

* * * * *